United States Patent [19]
Barry et al.
[11] 3,934,817
[45] Jan. 27, 1976

[54] PRECIPITATION OF STEAM FOGS

[75] Inventors: Robert E. Barry, Ann Arbor; Vincent J. Herter, Livonia, both of Mich.

[73] Assignee: The Detroit Edison Company, Detroit, Mich.

[22] Filed: Mar. 7, 1974

[21] Appl. No.: 448,925

[52] U.S. Cl. ..... 239/2 R; 239/14
[51] Int. Cl.[2] ..... A01G 15/00
[58] Field of Search ..... 239/2 R, 14, 23

[56] References Cited

UNITED STATES PATENTS

| | | | |
|---|---|---|---|
| 1,053,133 | 2/1913 | Potts | 239/14 X |
| 1,284,042 | 11/1918 | Balsillie | 239/2 R X |
| 1,356,484 | 10/1920 | Boltas | 239/14 X |
| 3,438,576 | 4/1969 | Handman | 239/2 R |
| 3,622,074 | 11/1971 | Frohwerk | 239/23 X |
| 3,741,480 | 6/1973 | Huisen | 239/2 R |

*Primary Examiner*—Lloyd L. King
*Assistant Examiner*—Michael Mar
*Attorney, Agent, or Firm*—Whittemore, Hulbert & Belknap

[57] ABSTRACT

The invention has both environmental and energy solving implications. A high voltage electrical field is established intermediate a power plant cooling system which inherently produces large quantities of water vapor and is located between the cooling system and a traffic area so as to eliminate or materially limit fog particles when weather conditions would otherwise create fog, and by movement of air, carry the fog to or across the traffic area.

22 Claims, 3 Drawing Figures

PRECIPITATION OF STEAM FOGS

BRIEF SUMMARY OF THE INVENTION

The present power shortage suggests proliferation of nuclear power plants and unquestionably full utilization of this source of energy can go far to eliminate the present energy shortage. However, troublesome problems are presented whenever a site is proposed for the erection of a power plant, particularly a nuclear power plant. One of the objections raised both by environmentalists as well as traffic control and other agencies relates to fog production and drifting of a heavy fog curtain across a traffic area, such for example as a highway, an airfield, or the like. This of course poses a serious traffic problem since a dense fog may limit visibility in extreme cases to only a few feet.

A second very undesirable result of the drift of heavy fog from a cooling system to or across a traffic area is that under certain conditions the fog freezes and produces ice of the highway or other traffic area. This is particularly dangerous because the ice as formed tends to be in the form of a thin coating of glare ice capable of causing complete loss of traction and/or steering.

Nuclear power plants as they are at present constituted produce very large quantities of heat which must be continuously dissipated to provide for continuous operation of the nuclear power plant. The usual method of eliminating the waste heat produced by nuclear power plants is the provision of water cooling systems, and this in turn results in the production of large quantities of hot or at least partially warm water. This again, poses a problem for the environment, since discharge of such heated water into flowing streams, lakes or the like, is usually considered to be deleterious, notably as a hazard to fish life.

Different cooling systems have been devised which operate to dissipate large quantities of heat, taking advantage of the heat of vaporization of water.

One of the cooling systems involves the use of a bypass canal from which water is drawn to a nuclear power installation where it absorbs heat from the installation and is returned to the canal as warm or hot water. Of course, as this warm or hot water mixes with the relatively cold water flowing through the canal, its effect is to produce a much smaller rise in temperature of the cold water. Even the relatively small rise in temperature of the cold water, under certain conditions, can be considered objectionable as a potential threat to the environment. Accordingly, rafts or floats are anchored on the surface of the water in the canal and these rafts or floats are provided with open spray units which project or spray water upwardly into the air where it partially evaporates and the remainder of the water returns in substantially cooler condition into the canal.

Another cooling system is a mechanical draft cooling tower which in general comprises a horizontally elongated enclosure in which heated water flows over structure such as a wooden lattice and is cooled by means which includes air circulated through the tower. Warm air substantially saturated with water vapor is emitted upwardly from the tower through a plurality of upwardly directed stacks open at their top.

A third cooling system involves natural draft cooling towers which are of considerable height and which depend upon convection flow of air upwardly as it is heated. This warm air is substantially saturated with water vapor and is discharged upwardly from the open top of the tower.

In all cases, means are provided in properly spaced relation both in a horizontal and vertical sense, between the cooling system and the traffic area, for the purpose of eliminating or at least substantially reducing the amount of condensed fog-forming water particles which would otherwise be carried by the instantaneous flow of atmosphere air to or across the traffic area. The means for elminating or reducing the water particles comprise means for establishing a high voltage electrical field having an intensity such as to cause a corona discharge. In some cases this means may simply comprise a wire, or a plurality of wires extending horizontally above the ground so as to establish the electrical field between the wires and the ground. In other cases, particularly where the warm moist air is discharged at a considerable height, the field forming means may comprise one or more high voltage wires spaced apart from and usually above a grounded structure which in turn is located above the ground level.

DETAILED DESCRIPTION

Figure 1:
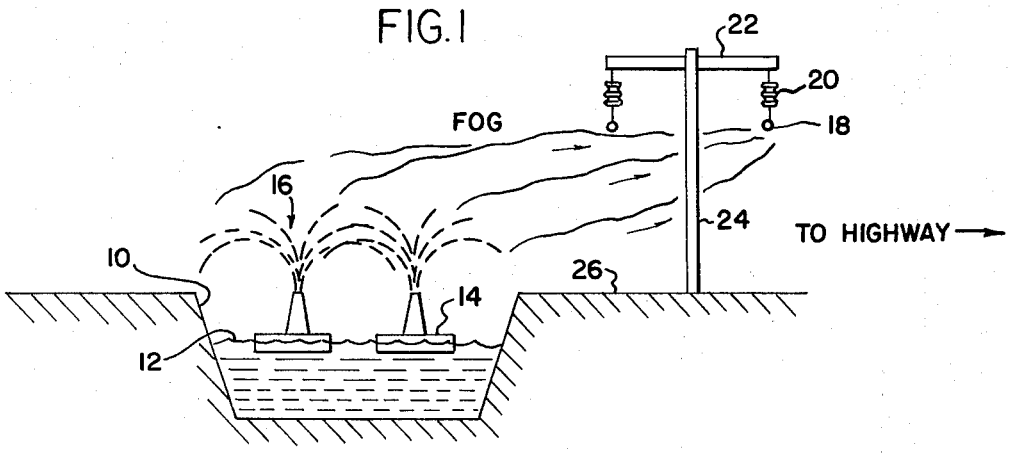
FIG. 1 is a diagrammatic sectional view illustrating the invention applied to a canal spray type cooling system.

Referring first to FIG. 1 there is illustrated a canal 10 having water indicated at 12 flowing therethrough. This canal may be established as a bypass between spaced points on a flowing stream so that the current flows through the canal at a controlled rate. Alternatively, the canal may extend from different points on a pond or lake, in which case there may or may not be flow through the canal. If a flow is desired it may require means for inducing such a flow.

Obviously, instead of providing a canal, the structure which will now be described may be applied to a pond or even a limited portion of a larger body of water.

While other industrial uses may require cooling water in such quantities as to render the present invention useful, the problem of cooling power plants and particularly nuclear power plants represents an extreme case in which the requirement is of dissipating relatively large amounts of heat. Accordingly, reference herein may be made to nuclear power plants but it is to be understood that this is merely representative of any industrial use which results in the production of large quantities of heat which is dissipated by water cooling, and which therefore results in the continuous production of large quantities of hot water.

In some cases it is found that the required flow of hot water and the temperature to which the water is heated in performing its cooling function is such that the water 12 in the canal 10 or in a lake or pond results in raising the temperature of the water to an unacceptable degree. Accordingly, arrangements have been proposed for effecting a substantial cooling of the water 12. In one particular example, a plurality of floats 14 are anchored in the canal and include motors and pumping means which project upwardly directed sprays of water as indicated at 16. The water as it is sprayed upwardly will ordinarily be above the temperature of ambient air so that a certain amount of cooling takes place merely as a result of heat transfer to the air. However, a much larger quantity of heat is dissipated by evaporation of water particles of the spray, this heat being dissipated in furnishing the heat of vaporization of the water. Accordingly, the residual spray falls back into the canal in a substantially cooled condition, and under proper circumstances and with appropriate controls, the temperature of the water 12 may be prevented from reaching a predetermined upper limit.

As a result of evaporation of relatively large quantities of water into the atmosphere, conditions are established which given certain meteorological parameters, will result in condensation of water vapor into water particles and more specifically, into a relatively dense collection of airborne water particles constituting a fog. Assuming a drift as a result of a prevailing wind in a given direction, this fog may travel for substantial distances and may cross or even accumulate on traffic areas such as highways, airfields, or the like.

The conditions which cause the production of a relatively dense fog may be relatively rare and a prevailing wind in a direction which will cause the fog to move toward the aforesaid traffic area may also be relatively rare. However, when the combination of meteorological parameters is such that the fog is produced, and when the wind direction is such that the fog traverses a traffic area, the results can be extremely dangerous. Not only does the fog in some cases constitute a substantially impenetratable blanket in which visibility may be reduced to a few feet, but also, given the proper meteorological parameters including temperature, the fog may be caused to collect and freeze in the traffic area, thus producing a further serious traffic hazard.

In FIG. 1, the legend "To Highway" designates the direction to the traffic area, and the arrows adjacent the legend "Fog" designate the instantaneous direction of atmospheric air drift or wind. In the Figure no attempt has been made to indicate at precisely what point the fog formation is initiated. However, it is appreciated that the warm air, which may be substantially saturated with water vapor, will travel some distance before it cools and condensation of the water vapor into fog droplets occurs.

In any case, at a sufficient horizontal distance from the spray floats 14, and in the direction of the traffic area there is provided means for establishing a strong electrical DC, or rectified AC field. This may be provided by one or a plurality of horizontally extending parallel spaced apart electrical conductors 18 herein illustrated as suspended from insulating means 20 and cross bars 22 carried by poles 24. It will be understood that the conductors 18 are connected to a source of high voltage direct current potential and that as a result of the high voltage carried by the conductors 18, a relatively strong electrical field is established beneath the conductors and specifically between the conductors 18 and ground designated 26. The intensity of the electrical field is such that corona discharge conditions prevail. Entry of the water particles into the field can either add electrons to the water particles or strip electrons from the water particles, depending on the polarity of the conductors, leaving the particles in a charged condition such that they migrate through the field to ground. The percentage of the particles entering the field which are actually caused to contact the ground may depend upon conditions such as the average particle size, the rate of movement of ambient air (wind), the strength of the electrostatic field, etc. In any case however, travel of the electrical field by the fog particles results in the effective elimination by movement to ground of some of the particles with a corresponding reduction in fog density.

Referring to FIG. 1 it will be noted that two conductors 18 are illustrated and they are carried by insulators 20 at a height such as to be above the flow of any fog which is considered to be dangerous to the traffic area such as a highway whose direction is designated by the arrow. The actual height of the conductors 18 above ground may be very substantial and no effort has been made to show the relationship of wire spacing and height of the conductors above the ground to scale. The actual vertical spacing of the conductors 18 from the ground may be for example, 50 – 100 feet and in such cases, a direct current potential applied to the conductors 18 of between 40,000 and 100,000 volts may establish the requisite corona discharge conditions.

One requirement which is taken into account in locating the conductors 18 is that the conductors should be spaced horizontally from the spray floats at a distance sufficient to permit the condensation of substantially all of the water vapor into droplets. This is because the water vapor as such is not believed to be materially affected as it traverses the electrostatic field, whereas, the actual condensed and coagulated water droplets become charged and are moved to or toward the ground by the field. In general, it may be said that the horizontal spacing of the conductors from the spray units should be at least between 50 and 100 feet, and may be considerably more, depending on topography and other conditions.

The height of the conductors is of course the minimum height which will cause the field to intercept enough of the fog flow to result in acceptable conditions at the traffic area.

It may be noted that in most cases there is no serious objection to the formation and drift of fog except where such drift intersects a traffic area or the like. However, if may be noted that in some areas occupied by manufacturing plants, particularly those requiring exterior electrical equipment, or even residential buildings, even though little or no vehicular traffic may be involved, these are included within the designation of traffic area.

Figure 2:
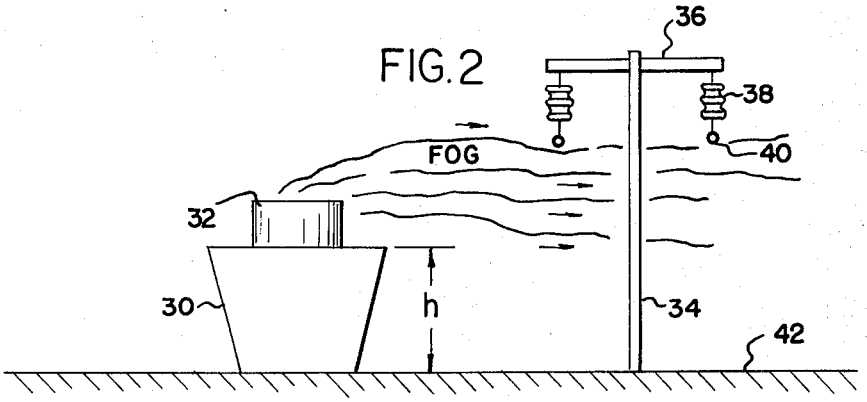
FIG. 2 is a diagrammatic view illustrating the invention applied to a mechanical draft cooling tower.

Referring now to FIG. 2 the invention is illustrated as applied to a mechanical draft cooling tower 30. Cooling towers of this type may be horizontally elongated to a length or, for example, 150 feet, and the tower itself may have a height *h* on the order of 50 feet and the upwardly extending cylindrical vents designated at 32 may have an additional height of approximately 25 feet. Mechanical draft cooling towers of this type are normally provided within the tower proper designated at 30, with a lattic work of wooden elements over which the water to be cooled is caused to flow. Air is drawn into the tower and discharged through the vents 32 by fans usually located in the vents. As the air traverses the water flowing over the lattice work, substantial evaporation occurs with a relatively great dissipation of heat taken up in supplying the heat of vaporization of the water. As a result of this the moisture saturated air which is emitted upwardly from the vents 32 is at a height of perhaps 75 feet above the ground. In this case the means for providing the high voltage electrostatic field comprises a plurality of poles 34 with cross pieces 36 having insulators 38 suspended therefrom, which in turn suspend the electrical conductors 40. The height of the conductors 40 above the ground 42 may accordingly be over 100 feet, to be positioned at an elevation such that the fogs which are to be eliminated will for the most art pass beneath the conductors as illustrated. In this case, the spacing of the conductors 40 above ground may be materially greater than that provided in the system illustrated in FIG. 1. In any case however, the elevation of the conductors above ground will influence the direct current voltage which is applied to the conductors, this as before being such as to establish a corona discharge.

As in the embodiment of the invention previously described, the lateral spacing of the conductors from the mechanical draft cooling tower is such as to permit substantially complete condensation of water vapor into fog droplets before traversal of the electrostatic field.

Usually, the conductors 40 will be spaced horizontally from the cooling tower by at least a distance of 50 – 100 feet.

In the embodiments illustrated in FIGS. 1 and 2, while two parallel horizontal conductors respectively designated 18 and 40 in the Figures, are illustrated, the use of a larger number of conductors is contemplated and the selection of the number of conductors will depend upon prevailing conditions. For example, five conductors may be provided extending in a direction generally perpendicular to and in the path of fog flow from the cooling system to the traffic area and the individual conductors may be spaced apart approximately 4 feet.

Figure 3:
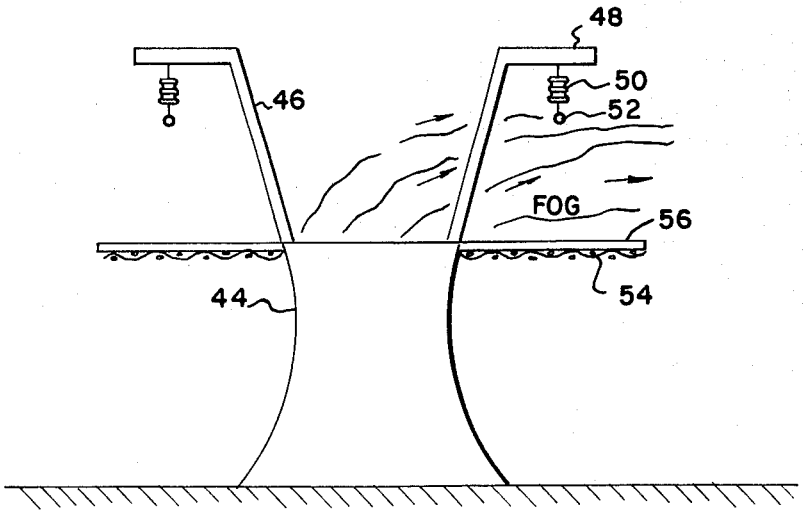
FIG. 3 is a diagrammatic elevational view showing the invention as applied to a natural draft cooling tower.

In FIG. 3 there is illustrated the application of the present invention to a natural draft cooling tower, herein designated at 44. Towers of this type are generally of circular cross-section and of relatively great height as for example, approximately 400 feet. The water which is cooled within the tower warms the air which flows through the tower upwardly by convection and there is a substantial evaporation of water with resultant cooling as a result of heat used in evaporation of the water. As a result, the warm moisture laden air flows by convection out of the upper top of the tower. Carried at the top of the tower are a plurality of upstanding supports 46 having outwardly radially extending arms 48 from which are suspended insulators 50 carrying high voltage conductors 52. While the conductors 52 may be located at one side only of the towers 44, it is contemplated that in this case the conductors may be arranged in a circle surrounding the tower and again, while only a single conductor 52 is illustrated, it is contemplated that more, as for example five, concentric parallel conductors may be provided.

While the tower 44 may be 400 feet high, no attempt has been made to show the dimensions of the suppports 46 to scale. In practice, the conductors 52 will be located at least 50 feet horizontally from the adjacent top edge of the tower and it is contemplated that they will be provided at an elevation of about 100 feet from the horizontal plane occupied by the top of the tower. With this arrangement, substantial, if not complete, condensation of water vapor into water droplets occurs before traversal of the electrostatic field and at the same time the field extends vertically through a sufficient distance to intercept any fog flow which would be troublesome.

In this case, due to the relatively great height of the tower, it is not practical to depend upon the ground upon which the tower is constructed as the electrical ground cooperating with the conductors for establishing the field. Accordingly, in this construction a grounded grid 54 is provided supported on radially extending arms 56 and the electrostatic field is of course thus established between the conductors 52 and the grounded grid 54.

While reference has been made to the use of the electrostatic field to dissipate fog in connection with cooling systems provided for nuclear fuel plants, similar requirements may require the equipment in other power plants such for example as those employing fossil fuel. In general, it is anticipated that the power supplied for an 800 megawatt power plant may be supplied by a 50 megawatt unit. While such power consumption represents a substantial fraction of the power output of the power plant, it will be appreciated that operation of the electrostatic dissipation of fog can be expected to be required only for a small percentage of time, as for example, less than 10%. Accordingly, the use of the electrostatic fog dissipation is economically feasible particularly when it is considered that it may provide the solution of obtaining approval of sites for power plants which might not otherwise be available.

Inasmuch as the functioning of the system requires the corona discharge, this may result in the preferential use of electrical conductors of particular design. In general, the conductors should be of minimum cross-sectional area to increase the electrical gradient. In some cases the electrical conductors may be provided with a multiplicity of points at which the corona discharge may take place. While ordinarily it is contemplated that the conductors will be formed of copper, a suitable copper alloy, or aluminum, ordinary barbed wire of essentially ferrous alloy may be employed because the presence of the pointed barbs at frequent intervals on the wires promotes corona discharge, and the relatively greater resistance of the wire as compared to copper or aluminum, is not a serious disadvantage under the conditions of use.

Reference has been made in the foregoing to the particular spatial relationship between the cooling system, the means for precipitating or dissipating fog, and the traffic area which is to be protected from the fog. It is within the contemplation of the present invention that the means for dissipating the fog shall constitute portable apparatus so that it may be moved into position between the cooling system and the area to be protected, dependent on the prevailing wind.

What we claim as our invention is:

1. A water cooling system for cooling water comprising heat transfer means for contacting the water with a flow of air to simultaneously heat the air, to evaporate water into the air, and to release the warm air containing water vapor into the atmosphere, a traffic area such as a highway or airport in the vicinity of said cooling system in position to receive a dense fog from said cooling system under fog favoring atmospheric conditions and a prevailing wind moving from the cooling system toward the said area, fog dissipating means interposed between the cooling system and area comprising means for establishing a high voltage electrical field through which air traversing the cooling system passes on its way to the traffic area, said fog dissipator being located in horizontally spaced relation to said cooling system such that under meteorological conditions effective to produce substantial fog conditions at said traffic area by condensation of water vapor and migration of fog so produced, substantial condensation of water vapor into fog particles occurs before reaching said fog dissipating means, the fog dissipating means comprising one or more horizontally extending conductors spaced above the path of passage of fog from the traffic area, grounded structure disposed directly below such conductors and below such path, and means for establishing a high voltage unidirectional field between the conductors and ground.

2. The system defined in claim 1 in which the conductors are located to establish the electrical field between the conductors and the ground.

3. The system defined in claim 1 in which the cooling system comprises a tower from the top of which the fog-forming water vapor is discharged, and in which the means for establishing the electrical field comprises one or more conductors spaced substantially above the tower, and a ground construction located substantially at the vertical level of the top of said tower.

4. The system defined in claim 1 in which said cooling system comprises a canal for cooling water, and floats on said canal having spray means thereon for spraying water upwardly from the canal to fall back into the canal.

5. The system defined in claim 1 in which said cooling system comprises a mechanical draft cooling tower having a plurality of upwardly directed vents through which air and water vapor are discharged.

6. The system defined in claim 1 in which said cooling system comprises a natural draft cooling tower of circular horizontal cross-section and at least 200 feet high having an open top from which air and water vapor flow by natural convection.

7. The system defined in claim 6, the means for establishing the high voltage field comprising one or more high voltage charged conductors spaced substantially above the horizontal plane of the top of said tower and spaced laterally therefrom to provide for fog particle formation before entry of the air and water vapor and condensate into the field.

8. The system defined in claim 1 in which said conductors are barbed wire formed of ferrous metal.

9. A water cooling system for cooling water comprising heat transfer means for contacting the water with a flow of air to simultaneously heat the air, to evaporate water into the air, and to release the warm air containing water vapor into the atmosphere, electrostatic fog dissipating means including means for establishing an electrostatic field located in horizontally spaced relation with respect to said cooling system such that under meteorological conditions effective to produce substantial fog conditions by condensation of water vapor and migration of the fog so produced, substantial condensation of water vapor into fog particles occurs prior to entry into the electrostatic field, the fog dissipating means comprising horizontally extending electrical conducting means, means for supplying a high voltage electrical DC or rectified AC potential to said conducting means, and an electrical ground spaced downwardly from said conducting means to define a field area between said conducting means and ground located to intercept fog formed from condensed water vapor from said cooling system and moved laterally therefrom by horizontal movement of ambient air.

10. The system defined in claim 9 in which said electrical ground is established by the physical ground support for said cooling system.

11. The system defined in claim 9 in which said fog dissipator is of limited horizontal extent, and is located so as to intercept fog flow from said cooling system only in a pre-selected direction.

12. The system defined in claim 9 in which said cooling system comprises a tower having means adjacent the top thereof at which the heated air carrying the water vapor is released, in which said conducting means are located above and spaced laterally from the top of said tower, and said electrical ground is located generally in the horizontal plane of the top of said tower and beneath said conducting means.

13. The system defined in claim 12 in which said conducting means and electrical ground surround said tower.

14. The system defined in claim 9 in which said conducting means comprises barbed wire formed of ferrous metal.

15. A water cooling system for cooling water comprising heat transfer means for conacting the water with a flow of air to simultaneously heat the air, to evaporate water into the air, and to release the warm air containing water vapor into the atmosphere, a traffic area such as a highway or airport in the vicinity of said cooling system in position to receive a dense fog from said cooling system under fog favoring atmospheric conditions and a prevailing wind moving from the cooling system toward the said area, and fog dissipating means interposed between the cooling system and area comprising means for establishing a high voltage electrical field through which air traversing the cooling system passes on its way to the traffic area, in which the cooling system comprises a tower from the top of which the fog-forming water vapor is discharged, and in which the means for establishing the electrical field comprises horizontally extending conducting means spaced substantially above the tower, and a ground construction located substantially at the vertical level of the top of said tower, said conducting means and ground construction being located laterally from said tower a distance such that substantial condensation of vapor into fog particles will occur before the air flow reaches the field.

16. A water cooling system for cooling water comprising heat transfer means for contacting the water with a flow of air to simultaneously heat the air, to evaporate water into the air, and to release the warm air containing water vapor into the atmosphere, a traffic area such as a highway or airport in the vicinity of said cooling system in position to receive a dense fog from said cooling system under fog favoring atmospheric conditions and a prevailing wind moving from the cooling system toward the said area, and fog dissipating means interposed between the cooling system and area comprising means for establishing a high voltage electrical field through which air traversing the cooling system passes on its way to the traffic area, in which said cooling system comprises a natural draft cooling tower of circular horizontal cross-section and at least 200 feet high having an open top from which air and water vapor flow by natural convection, the means for establishing the high voltage field comprising one or more high voltage charged conductors spaced substantially above the horizontal plane of the top of said tower and spaced laterally therefrom to provide for fog particle formation before entry of the air and water vapor and condensate into the field.

17. The method of preventing drifting in a predetermined direction of fog produced by condensation of water vapor contained in warm air released from a cooling system in which water is heated incident to cooling a heat source and is cooled in part by evaporation into an air flow released from the cooling system into the atmosphere which comprises positioning horizontally extending conductor means in a position above the path of fog drift in such predetermined direction and at a distance laterally from the cooling system such that condensation of a substantial part of the water vapor that would condense to form fog under prevailing meteorological conditions will occur before the air carrying the fog particles and water vapor passes beneath the conductor means, establishing a ground potential directly below said conductor means and below the aforesaid flow path, and establishing a high unidirectional potential on the conductor means to produce downward migration of charged fog particles toward the ground potential.

18. The method as defined in claim 17 in which the cooling system comprises a tower from the top of which the fog forming water vapor is discharged, which comprises providing grounded structure located generally in the horizontal plane containing the top of the tower.

19. The method as defined in claim 17 in which the cooling system comprises a natural draft cooling tower of circular horizontal cross-section and at least 200 feet high having an open top from which air and water vapor flow by natural convection, which comprises providing the ground potential by supporting a grounded structure from the top portion of the tower.

20. The method of cooling water without producing a fog drift in a predetermined direction under a given set of meteorological conditions which comprises evaporating some of the water to be cooled into a flow of warm air to produce a substantial water vapor content in the air, releasing the air and water vapor into the atmosphere, positioning horizontally extending electrical conducting means above the path of flow of air in such predetermined direction and at a distance laterally from the point of release such that condensation of a substantial part of the water vapor that would condense to form fog under prevailing meteorological conditions will occur before the air carrying the fog particles and water vapor passes beneath the conductor means, establishing a ground potential directly beneath the conducting means and below such path, establishing a high unidirectional potential on the conducting means to produce downward migration of fog particles.

21. The method as defined in claim 20 which comprises evaporating some of the water to be cooled into a tower from the top of which the warm air and water vapor are released, and providing the ground potential on structure located generally in the horizontal plane of the top of the tower.

22. The method as defined in claim 21 which comprises supporting both the electrical conducting means and the grounded structure from the upper portion of the tower.

* * * * *